US008579395B2

(12) United States Patent
Smektala

(10) Patent No.: US 8,579,395 B2
(45) Date of Patent: Nov. 12, 2013

(54) INTEGRATED PRINT HEAD END-OF-LIFE DETECTION

(75) Inventor: Volker Smektala, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 226 days.

(21) Appl. No.: 12/863,719

(22) PCT Filed: Feb. 12, 2008

(86) PCT No.: PCT/US2008/053706

§ 371 (c)(1),
(2), (4) Date: Jul. 20, 2010

(87) PCT Pub. No.: WO2009/102322

PCT Pub. Date: Aug. 20, 2009

(65) Prior Publication Data

US 2010/0295884 A1 Nov. 25, 2010

(51) Int. Cl.

| | |
|---|---|
| ***B41J 2/195*** | (2006.01) |
| ***B41J 29/38*** | (2006.01) |
| ***B41J 29/393*** | (2006.01) |

(52) U.S. Cl.
USPC ..... 347/7; 347/17; 347/19

(58) Field of Classification Search
None
See application file for complete search history.

(56) References Cited

U.S. PATENT DOCUMENTS

| | | | | |
|---|---|---|---|---|
| 5,206,668 | A | 4/1993 | Lo et al. | |
| 5,315,316 | A | 5/1994 | Khormaee | |
| 5,508,722 | A | 4/1996 | Saito et al. | |
| 5,682,183 | A | 10/1997 | Wade et al. | |
| 5,699,090 | A | 12/1997 | Wade | |
| 6,086,194 | A | 7/2000 | Ikezaki | |
| 6,196,651 | B1 * | 3/2001 | Zuber et al. | 347/7 |
| 6,431,673 | B1 | 8/2002 | Heim | |
| 6,644,774 | B1 | 11/2003 | Burger et al. | |

FOREIGN PATENT DOCUMENTS

| | | | |
|---|---|---|---|
| EP | 0744296 | A1 | 11/1996 |
| JP | 05220974 | A | 8/1993 |
| JP | 09-011490 | A | 1/1997 |
| JP | 2005-088290 | A | 4/2005 |
| KR | 10-2007-0022293 | A | 2/2007 |

* cited by examiner

*Primary Examiner* — Geoffrey Mruk

(57) ABSTRACT

A method of detecting low ink levels in an integrated print head includes calibrating the integrated print head and producing a baseline temperature rise, performing an end-of-life test to produce a second temperature rise; and comparing the second temperature rise and the baseline temperature rise to estimate ink levels within the integrated print head. A computer product for detection of end-of-life events in integrated inkjet print heads includes computer code to perform a calibration procedure when an integrated print head is first connected to a printer; computer code to perform an end-of-life test on the integrated print head after a triggering event; and computer code to compare end of life test results with a baseline result from the calibration procedure.

20 Claims, 6 Drawing Sheets

INTEGRATED PRINT HEAD END-OF-LIFE DETECTION

RELATED APPLICATIONS

The present application claims the priority under 35 U.S.C. 119(a)-(d) or (f) and under C.F.R. 1.55(a) of previous International Patent Application No.: PCT/US2008/053706, filed Feb. 12, 2008, entitled "Integrated Print Head End-of-Life Detection", which application is incorporated herein by reference in its entirety.

BACKGROUND

When the ink runs low in an integrated print head on an inkjet printer, the printer may provide a low-on-ink warning message. This low-on-ink message is intended to warn the customer that the ink may soon run out. Printers also provide an out-of-ink message to tell the user when to change the ink print head.

Ideally these warning messages should coincide with actual low-on-ink and out-of-ink events and allow the user to maximize the life of the print head while avoiding print quality degradation. However, current methods for estimating ink levels within integrated print heads are based on average statistical measures of a large print head population. Consequently, end-of-life detection can be inaccurate for specific print heads, causing waste and negative user perception.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1:
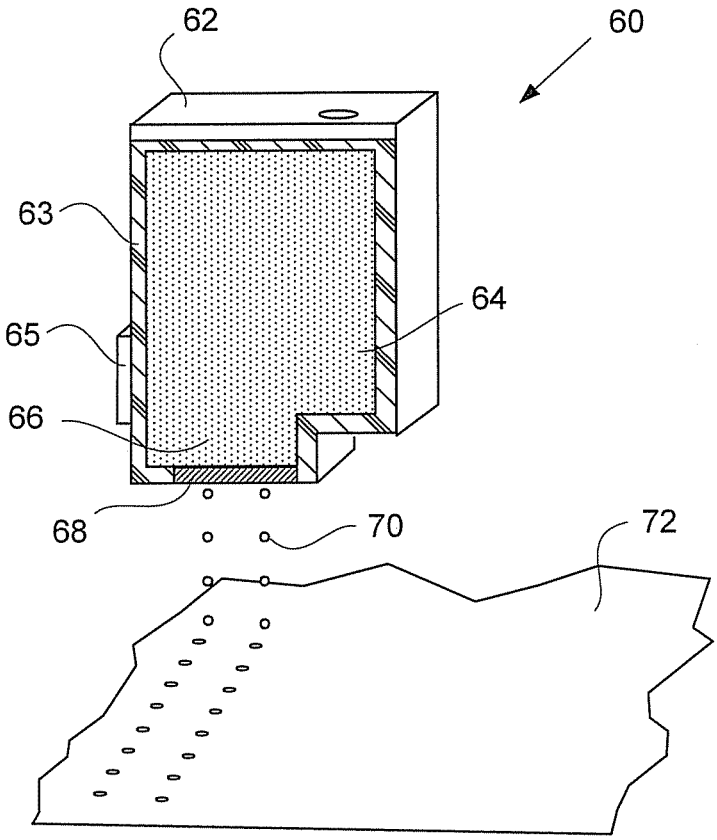
FIG. 1 is a diagram of an illustrative printing apparatus, according to principles described herein.

Integrated print heads contain both an ink reservoir and an ink dispensing mechanism in a single package. While it may be convenient to have both the ink reservoir and dispensing mechanism in a single integrated package, in many cases, the user cannot determine the levels of ink within the ink reservoir by routine inspection or observation.

Because the user may be unaware of the remaining ink level within an integrated print head, the ink supply may unexpectedly run out. This can result in lost time and wasted resources. Consequently, low-on-ink (LOI) and out-of-ink (OOI) messages may be provided in printing systems to assist the user in ascertaining the approximate level of ink in the print head. These messages are designed to maintain the printing quality of the printer and avoid potential waste of ink and paper.

For example, if a print head runs out of ink half way through printing a photograph, once the print head is replaced and the photograph finished, the first half of the photograph may have inaccurate color representation and poor print quality which makes the entire photograph unacceptable. This wastes all the ink and the paper used to print the photograph, including the ink dispensed by the replacement print head. LOI and OOI messages are intended to prevent this by allowing the user to switch in a new print head and prevent unexpected degradation in printing quality. However, it is advantageous for such messages to accurately reflect the condition of that specific integrated print head rather than merely reflecting the average performance of such print heads.

Consequently, the present specification will describe systems and methods for accurately advising users of the remaining ink supply available in an integrated print head. For purpose of explanation, a method and algorithm for detecting OOI and LOI events is described herein with reference to a specific thermal inkjet geometry described in U.S. patent application Publication Ser. No. 11/924,590 entitled "Bubbler" which was filed on Oct. 25, 2007, the disclosure of which is incorporated herein by reference in its entirety. U.S. patent application Publication Ser. No. 11/924,590 describes a thermal ink jet print head with a plurality of bubblers.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

FIG. 1 is a diagram of an illustrative printing apparatus (60) which uses an integrated print head (62) to create an image on a print medium (72). The integrated print head (62) comprises a housing (63) that encloses an ink reservoir (64). A memory unit (65) may be disposed with the housing (63) so as to be accessible by a printer or printing device in which the print head (62) is installed. The purpose and function of this memory unit (65) will be discussed below.

A thermal ink jet die (68) is placed in the lower end of the integrated print head (62). The thermal ink jet die (68) is connected to the main portion of the ink reservoir (64) by a smaller cross-section area called a standpipe (66). The print head (62) ejects ink droplets (70) in response to commands from the printer in which it is installed. The print head (62) and print medium (72) are moved with respect to each other such that the ejected droplets (70) form the desired image on the print medium (72). As droplets (70) are ejected, the level of ink within the ink reservoir (64) naturally drops.

There are various methods of detecting low-on-ink or out-of-ink events within the integrated print head (62). One method uses a weight sensitive switch that is activated when the weight of the ink in the print head reaches a certain threshold. Another method counts the number of drops that have been ejected from the ink print head and sends a signal when that number has reached a certain threshold. However, current end-of-life detection methods are based on statistical averages of a large integrated print head population. Integrated print head end-of-life detection can consequently be inaccurate for individual print heads within the population, causing waste and negative user perception.

Figure 2:
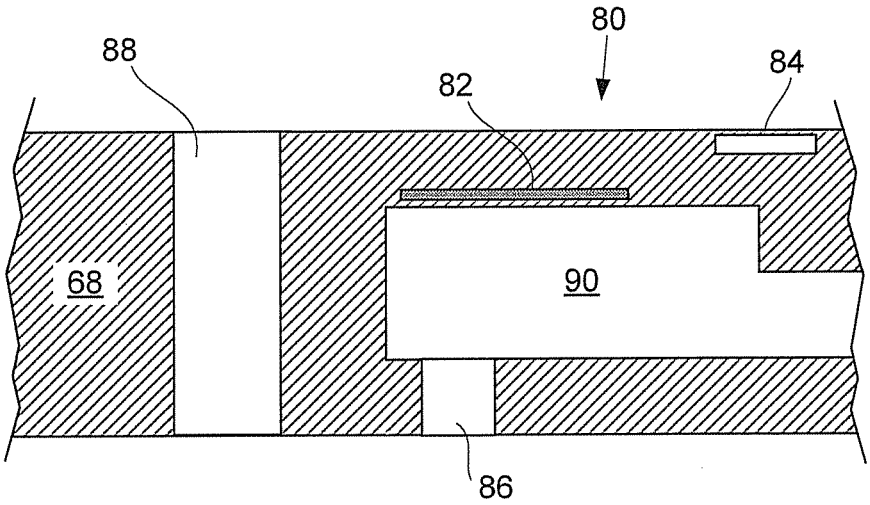
FIG. 2 is a diagram of an illustrative ink jet die showing a firing chamber and temperature sensor, according to principles described herein.

In an alternative method, a printer may sense changes in the thermal behavior of the integrated print head to detect LOI or OOI events. As shown in FIG. 1, thermal inkjet print heads typically comprise a fluid reservoir (64) in fluidic connection with an inkjet die (68). FIG. 2 is a cross-sectional diagram of an illustrative ink jet die (68) showing a firing chamber (80), a temperature sensor (84), and a bubbler (88). Each inkjet die (68) can contain a number of droplet generators (80). Each droplet generator (80) has a firing chamber (90), a heater element (82), and a nozzle (86). Fluid is drawn from the fluid reservoir (64, 66) into the firing chamber (90) by capillary action or by other forces. Under isostatic conditions, the fluid does not exit the nozzle (86), but forms a concave meniscus within the nozzle exit.

To eject a droplet from the droplet generator (80), a heating element (82) is proximally located to the firing chamber (90). Electricity is passed through the heating element (82), which causes the temperature of the heating element (82) to rapidly rise and vaporize a small portion of the fluid in the firing chamber (90) immediately adjacent to the heating element (82). The vaporization of the fluid creates a rapidly expanding vapor which overcomes the capillary forces retaining the fluid within the firing chamber (90) and nozzle (86). As the vapor continues to expand, a droplet is ejected from the nozzle (86).

Following ejection of an ink droplet (70), the electrical current through the heating element (82) is cut off and the heating element (82) rapidly cools. The envelope of vaporized fluid collapses, pulling additional fluid from the reservoir (64, 66) into firing chamber (90) to replace the fluid volume vacated by the droplet (70). The droplet generator (80) is then ready to begin a new droplet ejection cycle. The fluid surrounding the firing chamber (90) and the flow of fluid flow of fluid through the firing chamber (90) are primary cooling mechanisms for the droplet generator (80).

A bubbler (88) is an opening in the inkjet die (68) which is sized to permit air to be drawn through the opening in response to increasing back pressures generated when the amount of fluid within the ink reservoir (64) approaches exhaustion. By permitting air to be admitted into the inkjet reservoir (64), bubblers (88) reduce the back pressure to maintain print quality until the complete exhaustion of the ink or other printing fluid from the integrated print head (62). Bubblers (88) reduce or eliminate ink trapped in the reservoir, allowing the more efficient use of integrated print heads (62).

In addition to drop counting, printers can use changes in the thermal signature of the integrated print head to detect the LOI and OOI events. Each time an integrated print head (62) fires, the temperature of the ink jet die (68) increases slightly. The temperature of the inkjet die (68) can be sensed using a variety of methods, including using an on-chip temperature sensor (84). As the ink in a print head (62) runs low, the temperature increase when droplets are fired become detectably sharper because there is not as much ink to absorb the thermal energy used to eject the droplets.

As ink droplets (70) are expelled from the reservoir (64, 66), backpressure builds up in the ink reservoir (64, 66). When the backpressure reaches a certain threshold, bubblers (88) allow air back into the ink reservoir (64, 66) to relieve the backpressure. When all the ink in the print head (62) has been replaced by air, there is a dramatic increase in the temperature after a printing burst because the air is far less effective at absorbing the thermal energy than was the liquid ink. At the same time, printing quality sharply decreases because there is no more ink being provided to the printing nozzles. This thermal spike is indicative of the OOI event and is preceded by noticeable printing quality degradation. This characteristic rise in temperature as the ink levels decrease can be used to detect the LOI and OOI events.

According to one exemplary method for using thermal measurements to estimate ink levels, resistors in the ink jet die are used to heat the inkjet die to a given operating temperature. Next, a burst of ink is ejected from the inkjet die by firing one or more droplet generators multiple times (also called a "spit"). The temperature rise that accompanies the spit is measured. If the temperature exceeds a certain threshold, the printer signals that an OOI event has occurred.

This simple algorithm can be less effective in predicting actual OOI events because it compares the measured temperature to a preset threshold based on the average performance of similar print heads. The variation in the manufacture and filling of integrated print heads, however, creates natural disparities in the thermal characteristics of the print heads. The preset threshold must be set to a value that accounts for this variation over the entire population of print heads, which can lead to an early triggering of an OOI event in many cases. Early triggering of an OOI event is undesirable because the remaining ink in the print head is wasted and/or customers are dissatisfied with inaccurate ink level reporting by the printer.

Additionally, different inks may have different thermal properties, which can cause greater variations between integrated print heads filled with disparate inks. When one or more ink chambers are combined into one print head, each chamber's thermal signature can interfere with the adjacent chambers, making it more difficult to detect a threshold temperature without falsely detecting OOI events or missing actual OOI events.

According to one exemplary embodiment, the thermal detection method described above is modified in a number of ways to improve the accuracy of the LOI and OOI messages displayed to users and to reduce the amount of ink expended during ink level testing. First, the printer system tracks the droplet count for each print head and stores the accumulated droplet count on the print head itself. Consequently, each print head may have a memory unit (65, FIG. 1) disposed thereon to store the droplet count data.

Additionally, each integrated print head is calibrated when it is inserted into the printer. The calibration procedure is described below in connection with FIG. 3. By calibrating each individual integrated print head, the differences in the geometry, materials, and ink in the print heads can be accounted for.

Following calibration, the printer then enters one of two operational modes. If the droplet count recorded on the print head indicates that there is a low likelihood the print head will run out ink within a predetermined period of time or usage amount, the printer enters a first operational mode. The first operational mode is described below in connection with FIG. 4. In the first operational mode, the printer periodically checks the droplet count to determine if a preset number of droplets have been ejected from the print head. If the preset threshold has been exceeded, an LOI message is displayed and an end-of-life test is performed. The end-of-life test is further described below in connection with FIG. 5. The printer then enters the second operational mode in which additional end-of-life tests can be regularly or periodically performed to detect lower ink levels. The second operational mode is described below in connection with FIG. 6.

Figure 3:
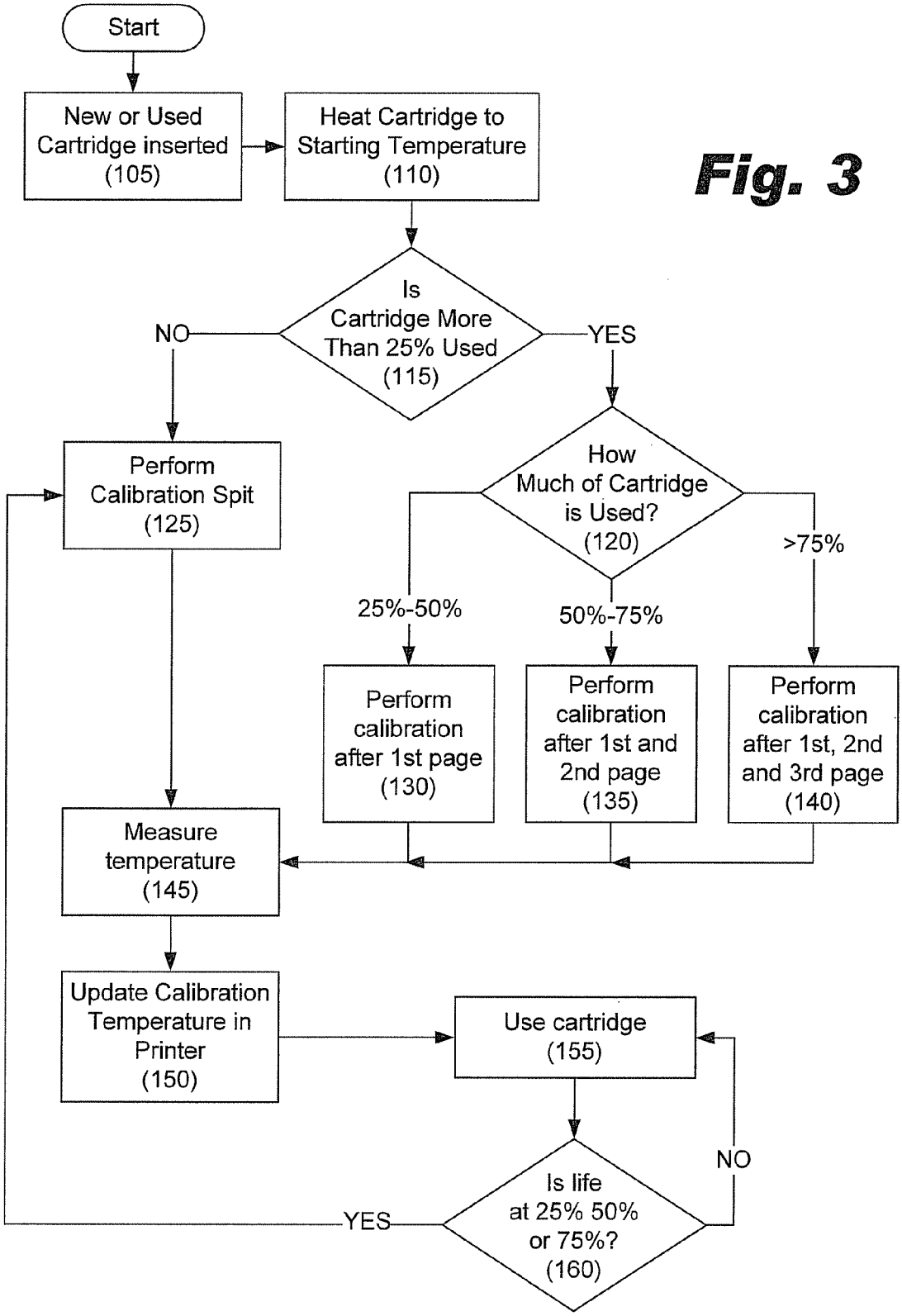
FIG. 3 is an illustrative flowchart which depicts one example of a calibration procedure for an integrated print head end-of-life system, according to principles described herein.

FIG. 3 is an illustrative flowchart which depicts one example of a calibration procedure for an integrated print head end-of-life detection system, according to principles described herein. The calibration procedure begins when a new or a used integrated print head is inserted into the printer for the first time (105). The ink jet die is heated (110) to a starting temperature, for example 60° C. Next, the printer determines if the print head is more than 25% used by, for example, checking the drop count stored in a memory unit on the print head itself, determining the weight of fluid in the print head, or by other means (115).

If less than 25% of the total ink contained within the print head has been expended, a calibration spit is performed (125). A calibration spit can be, for example, about 20,000 drops/nozzle. The details of the calibration will be described below.

In one embodiment, calibration is performed at 0%, 25%, 50%, and 75% of the ink supply expenditure based on drop count. The actual number of drops that can be dispensed by any given print head is unknown, but the average lifespan of all print heads can be determined and the 25%, 50% and 75% points set so that greater than 99% of all print heads are guaranteed to contain ink for use for a significant period beyond the 75% point. Therefore, the 25%, 50% and 75% points are predetermined and not necessary at the actual 25%, 50% and 75% depletion points of a particular print head. The calibration at each of these points provides a baseline that allows the algorithm to detect when the ink print head is full and when it is approaching an LOI or OOI event.

If the print head is more than 25% used, the printer determines the approximate percentage of ink remaining (120) by comparing the drop count recorded in the print head with preset values stored within the printer. Based on the drop count, if the print head is more the 25% used and less than 50% used, a calibration spit is performed after the first page is printed (130). If the print head has expended between 50% and 75% of total number of drops expected for that print head, a calibration spit is performed after the first and second pages (135). If the print head is more the 75% used based on the drop count, a calibration is performed after the first second and third pages (140).

After the calibration spit (125, 130, 135, 140), the temperature difference between the starting temperature (110) and a measured temperature (145) resulting from the heating that occurs during the calibration spit is determined and stored or updated (150) in the memory of the printer. The print head is then used as normal (155) until it is 25%, 50%, or 75% depleted (160) based on drop count. Each time the print head reaches 25%, 50% or 75% depletion, it is recalibrated.

In order to save ink, end-of-life testing is not performed when there is a very small likelihood of the print head being empty. Techniques for end-of-life testing will be described below. To determine when end-of-life testing should start, a drop count threshold, T1, is used. T1 is based on statistical measurements such that, for example, 99.6% of all print heads reach the T1 drop count before running out of ink. The end-of-life testing does not start until the drop count of the print head exceeds T1. Thus, the behavior of the algorithm before and after T1 is different.

Figure 4:
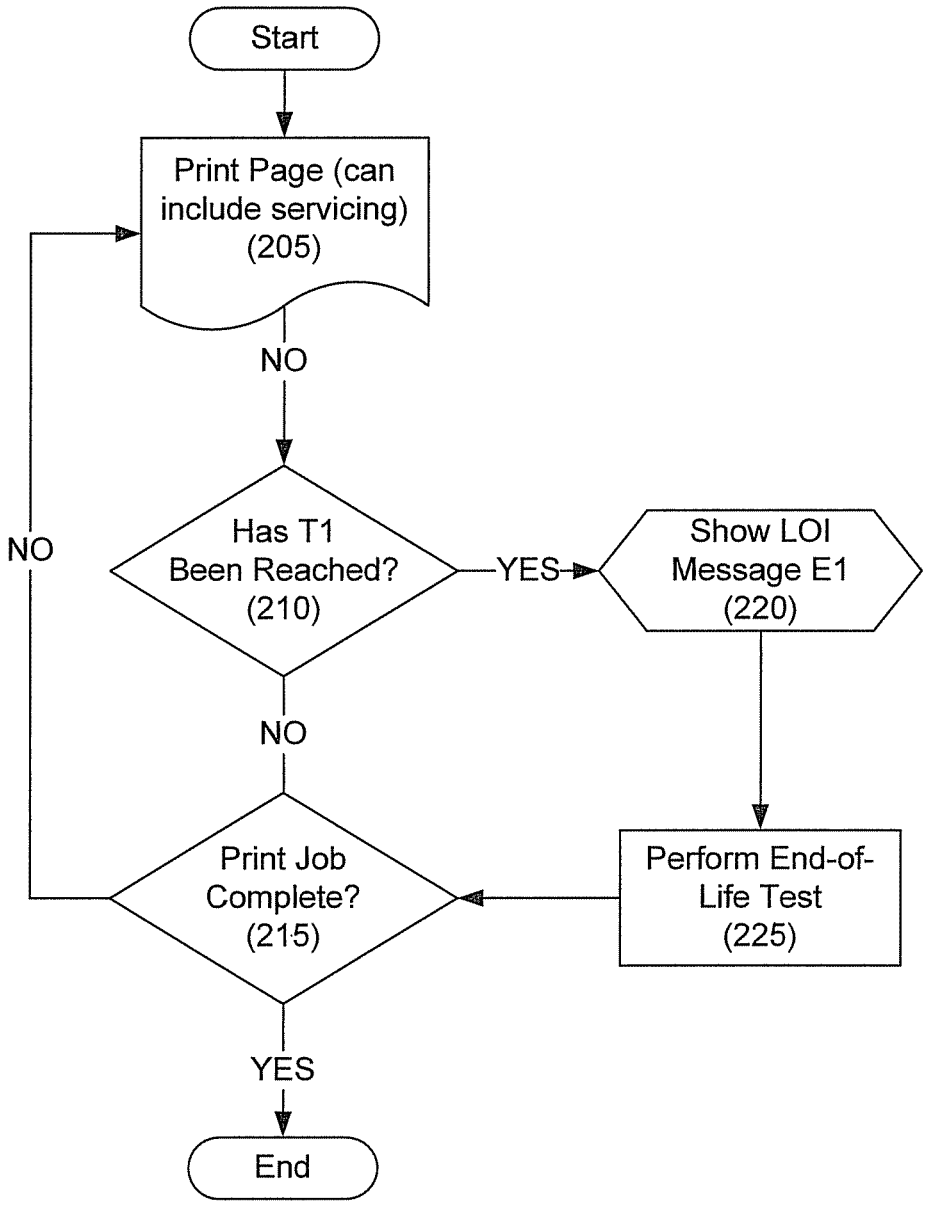
FIG. 4 is an illustrative flowchart which depicts one example of an algorithm for monitoring the ink levels within an integrated print head before a threshold drop count has been exceeded, according to principles described herein.

FIG. 4 is an illustrative flowchart which depicts one example of an algorithm for monitoring the ink levels within an integrated print head before the threshold drop count T1 has been exceeded. During a print job or service routine, a page is printed to completion (205). At the end of the page, the printer checks the drop count to see if T1 has been reached or exceeded (210). If T1 has not been reached, the printer checks to see if the print job is complete (215). If the print job is not complete, the printer returns to the first step and continues by printing the next page (205).

If T1 has been reached, a LOI message is displayed (220) because there is a high likelihood that the print head is low on ink. The end-of-life test is then run (225) for the first time on the print head. It is not known at this point exactly how much ink is in the print head or if it is empty. Ideally, the algorithm will detect a Very Low On Ink (VLOI) event and an OOI event some time after T1 is reached, but this will not necessarily always be the case. For example an OOI event may be detected without ever detecting a VLOI event. Similarly, the OOI event may be detected immediately during the end-of-life test (225), or in very rare cases, the print head may run out of ink before T1 is reached and begin to display print quality defects. After the ink level test is performed for the first time on that print head, the printer then checks if the print job is complete (215) and continues printing (205) if the job is incomplete.

Figure 5:
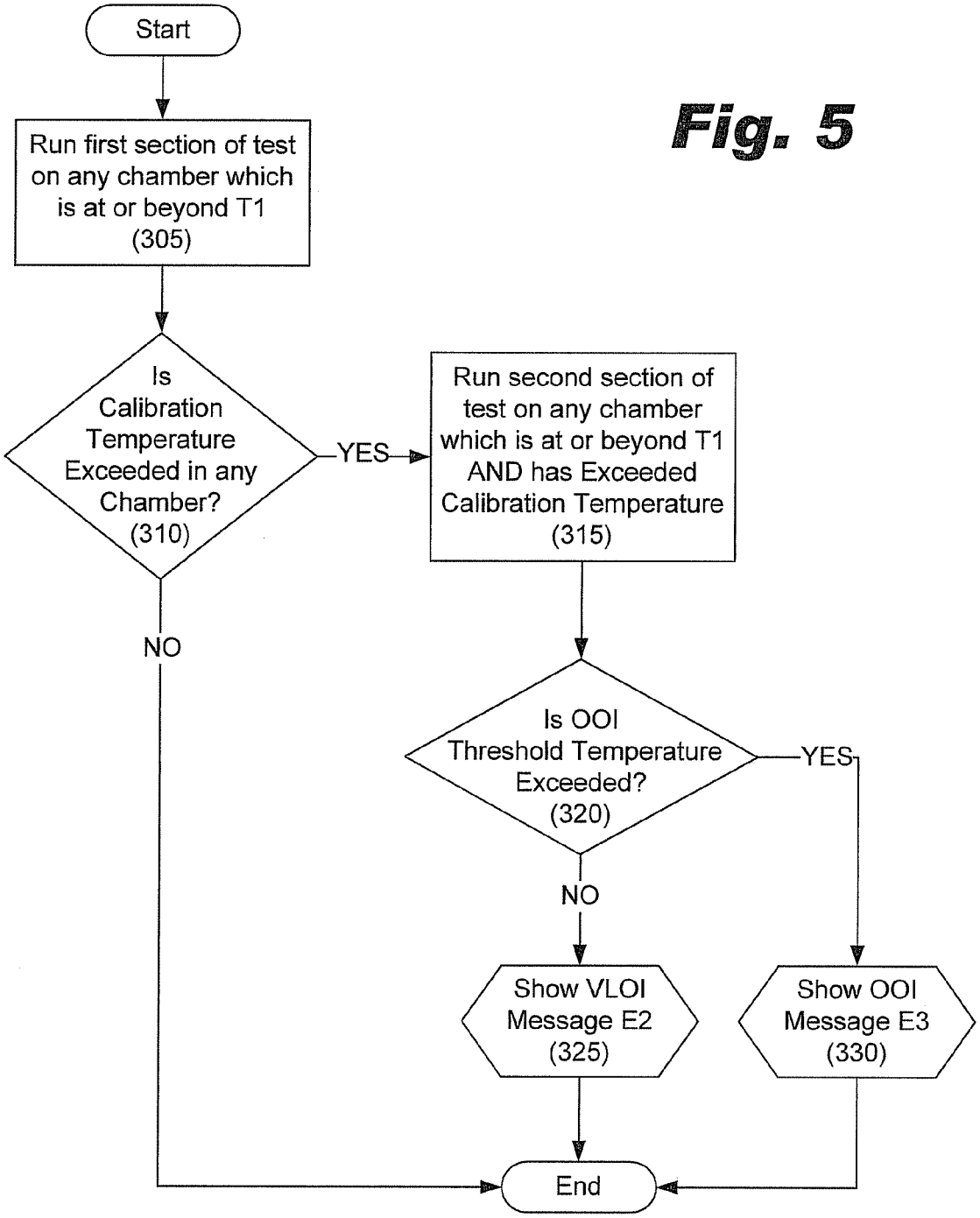
FIG. 5 is an illustrative flowchart which depicts one example of end-of-life test for detecting out-of-ink events by a printer, according to principles described herein.

FIG. 5 is an illustrative flowchart which depicts one example of an end-of-life test for detecting out-of-ink events by an integrated print head system. To conserve ink, the test is split into a first section and a second section. According to one exemplary embodiment, the first section includes five sub-spits, with the temperature of the print head measured after each sub-spit. The five sub-spits that comprise the first section of the test are selected so the temperature rise during the first section will not normally exceed the calibration temperature rise unless the ink level is low. Knowing this, measured temperatures of the ink chambers are compared (310) to the calibration temperature after the first section of the test. If the calibration temperature is not exceeded, the ink reservoir is not low and the testing algorithm can be terminated to prevent the ejection of additional ink. If the calibration temperature is exceeded, the ink levels may be low or approaching exhaustion. The remainder of the algorithm is then performed (315) by doing the last five spits and measuring the temperature associated with each ink chamber. The measured temperature is then compared (320) to the OOI threshold.

According to one exemplary embodiment, the OOI temperature will be significantly higher than the calibration temperature on a bubbler equipped inkjet die because the air in the ink reservoir heats up much faster than ink in the reservoir or standpipe. If the OOI temperature has not been exceeded, a VLOI message is displayed (325). If the OOI temperature has been exceeded, an OOI message is displayed (330). For a print head equipped with bubblers, this message will coincide very closely with an abrupt and distinct drop in print quality. This algorithm can work particularly well with print heads that are equipped with bubblers and can also be used with other print heads.

Figure 6:
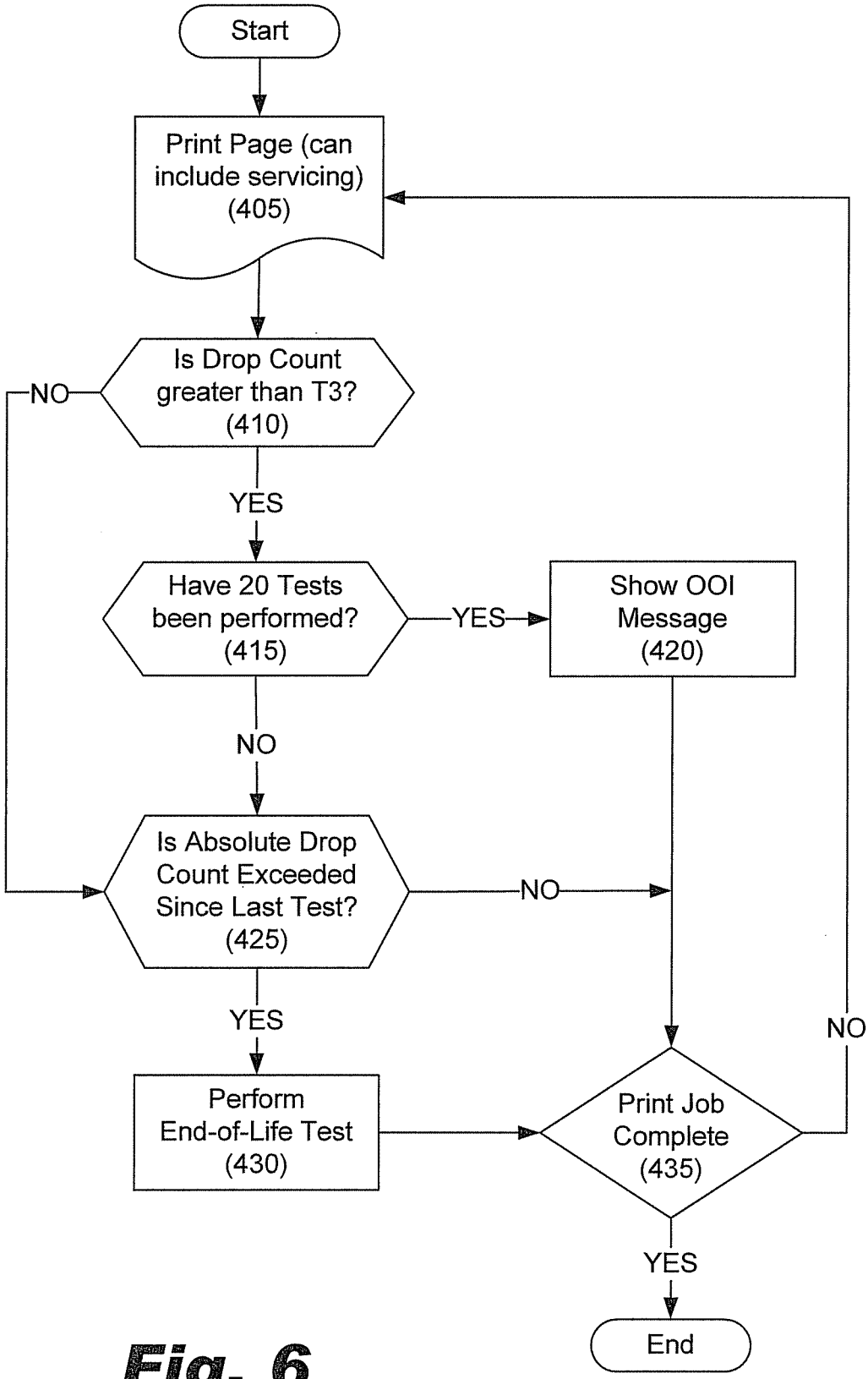
FIG. 6 is an illustrative flowchart which depicts one example of an algorithm for detecting out-of-ink events by a printer after a drop count threshold has been exceeded, according to principles described herein.

FIG. 6 is an illustrative flowchart which depicts one example of an algorithm for detecting out-of-ink events by a printer after a drop count threshold, T1, has been exceeded. After T1 has been reached, the integrated print head is assumed to be low on ink and the algorithm to detect VLOI and OOI events behaves differently. During a print job or service routine, a page is printed (405). The algorithm then checks to see if second drop count, T3, has been reached (410). The T3 threshold is set, based on statistical measurements, so that once it has been reached there is a very small probability that the print head still has a significant amount of ink in it.

If T3 has been reached or exceeded and a specified number of end-of-life tests, 20 for example, has been performed since T3 was reached, then all further end-of-life tests are stopped and the OOI message is displayed (420). This is done just in case the algorithm has failed for that particular print head and to reduce further issues that may arise from further testing on a spent print head. For example, the print head could be damaged and no longer recyclable if testing and printing continues when there is no ink. If T3 has been exceeded and the specified number of end-of-life tests has been performed on that print head, there is very little chance that the print head has any remaining ink, so this check acts as a failsafe to prevent further printing and testing using a print head that is likely to be completely out of ink.

In most cases, as many as 20 end-of-life tests will not be performed beyond the point that T3 is reached and the printer will check to see if an absolute drop count has been exceeded since the last end-of-life test on the particular print head or chamber. The absolute drop count is a measure of the maximum number of droplets that can be expected from a given print head. The absolute drop counts can be different for various print heads based on volume, viscosity, drop size, and other parameters. For example, in print heads use in inkjet color printers, a black print head may have an absolute drop count of 4,000,000; while a color print head may a yellow chamber with a drop count of 7,110,000, a cyan chamber with a drop count of 6,180,000, and a magenta chamber with a drop count of 5,860,000.

If the absolute drop count for the particular color of ink has not been exceeded since the last end-of-life test, the printer checks to see of the print job is complete (435). If the print job is not complete the printer continues printing (405). When the absolute drop count has been exceeded since the last end-of-life test, the end-of-life test is performed again (430). If the absolute drop count for that color of ink has not been exceeded, the printer checks to see of the print job is complete (435), and continues printing (405), if the print job is incomplete. The ink used does not have to be a color ink. It could be a conductive ink or a chemical signature ink and could be any liquid used for any purpose printed on any medium.

Figure 7:
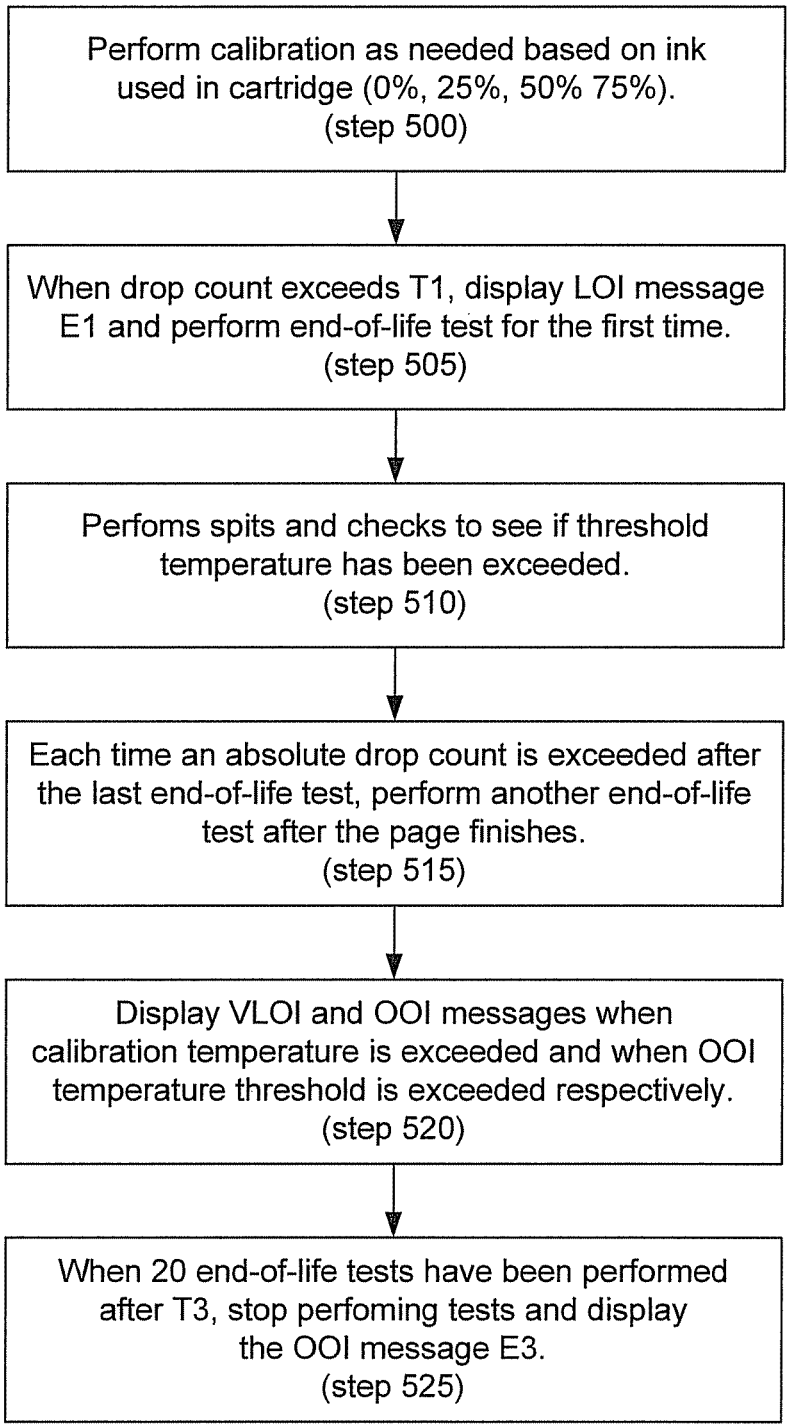
FIG. 7 is an illustrative block diagram which illustrates one exemplary method for detecting out-of-ink events, according to principles described herein.

FIG. 7 is an illustrative block diagram which illustrates one exemplary method for detecting OOI events. A calibration spit is performed at 0%, 25%, 50%, and 75% depletion (step 500) so the printer will know the temperature change resulting from firing a full ink print head a certain number of times, for example 20,000 times. After T1 has been reached or exceeded the end-of-life test is performed for the first time (505). The end-of-life algorithm performs a series of spits and measures the temperature change, checking to see if the threshold temperature has been exceeded (510). Each time an absolute drop count is exceeded since the last test on a particular print head or chamber in a multi-colorant pen, the end-of-life test is performed again (515). Appropriate warning messages are displayed when the print head has reached the VLOI and OOI states (520). If drop count T3 is exceeded and a specified number of end-of-life tests has been performed since T3 was exceeded, the tests are no longer performed and the OOI message is displayed (525).

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A method for detecting low ink levels in an integrated print head comprising:

calibrating said integrated print head when said integrated print head is first connected to a printer by performing a calibration spit and measuring a first temperature rise, said first temperature rise associated with said calibration spit and establishing said first temperature rise as a characteristic thermal baseline for said integrated print head;

performing an end-of-life test by ejecting a test spit and measuring a second temperature rise, said second temperature rise associated with said test spit;

comparing said first temperature rise and said second temperature rise to estimate ink levels within said integrated print head.

2. The method of claim 1, wherein said calibration further comprises:

heating at least a portion of said integrated print head to a base temperature;

ejecting a predetermined amount of ink from said integrated print head;

measuring said first temperature rise;

storing data containing said first temperature rise.

3. The method of claim 2, wherein said calibration is performed when said integrated print head is first connected to a printer; said data being stored a memory on said integrated print head.

4. The method of claim 3, wherein said calibration is performed periodically throughout a useful life of said integrated print head.

5. The method of claim 2, wherein said integrated print head comprises bubblers, said bubblers allowing air into an ink reservoir when a backpressure threshold is exceeded.

6. The method of claim 2, further comprising:

calculating a first drop count threshold, said first drop count threshold comprising a number;

maintaining a drop count, said drop count comprising an a cumulative count of a number of drops dispensed by said integrated print head;

comparing said drop count to said first drop count threshold to determine an approximate ink level within said integrated print head.

7. The method of claim 6, further comprising displaying a low-on-ink message if said drop count exceeds said first drop count threshold.

8. The method of claim 7, further comprising performing said end-of-life test when said drop count exceeds said first drop count threshold.

9. The method of claim 6, further comprising an absolute drop count limit, said absolute drop count limit being an estimate of a total amount of ink contained within said integrated print head; wherein said end-of-life test is performed when said drop count exceeds said absolute drop count limit.

10. The method of claim 2, wherein said end-of-life test further comprises:

performing a first series of sub spits and a second series of sub spits, making an intermediate temperature measurement after said first series of sub spits, comparing said intermediate temperature measurement to said first temperature rise; and, if said intermediate temperature exceeds said first temperature rise, performing said second series of sub spits.

11. The method of claim 1, further comprising an out-of-ink temperature threshold; said second temperature rise being compared to said out-of-ink temperature threshold; if said second temperature exceeds said out-of-ink temperature threshold an out-of-ink message is displayed.

12. The method of claim 11, wherein if said second temperature rise exceeds said first temperature rise but does not exceed said out-of-ink temperature threshold, a very-low-on-ink message is displayed.

13. A method for detecting low ink levels in an integrated print head comprising:

calibrating said integrated print head performing a calibration routine when said integrated print head is first connected to a printer, said calibration routine comprising heating at least a portion of said integrated print head to a base temperature, ejecting a predetermined amount of ink from said integrated print head, and measuring a first temperature rise resulting from said ejecting said predetermined amount of ink and, storing data containing said first temperature rise on said integrated print head, said first temperature rise being established as a characteristic thermal baseline for said integrated printhead;

performing an end-of-life test by ejecting a test spit and measuring a second temperature rise, said second temperature rise associated with said test spit;

maintaining a drop count, said drop count comprising an a cumulative count of a number of drops dispensed by said integrated print head;

providing a first drop count threshold, an absolute drop count threshold, and a out-of-ink temperature threshold;

comparing said drop count to said first drop count threshold or said absolute drop threshold to determine if said end-of-life test should be performed;

comparing said second temperature rise to said first temperature rise or said out-of-ink temperature threshold to estimate ink levels within said integrated print head;

displaying a message to a user to inform a user of said estimate of said ink levels.

14. A computer product for detection of end-of-life events in integrated inkjet print heads comprising a non-transitory computer readable medium having computer code embodied therein, said computer code comprising:

computer code configured to perform a calibration procedure when an integrated print head is first connected to a printer, said calibration procedure establishing a characteristic thermal baseline for said integrated print head;

computer code configured to perform an end-of-life test on said integrated print head after a triggering event, said computer code being further configured to measure a temperature rise associated with said end-of-life test;

computer code configured to compare said thermal baseline with said temperature rise and estimate a corresponding ink level within said integrated print head.

15. The computer product of claim 14, further comprising computer code configured to communicate said estimate of ink level to a user.

16. The computer product of claim 15, wherein said calibration procedure further comprises:

computer code configured to raise a temperature of at least a portion of said integrated print head to a base temperature;

computer code configured to eject an amount of ink from said integrated print head;

computer code configured to measure a temperature change resulting from said ejection of an amount of ink using a computer usable temperature sensor;

computer code configured to store data describing said temperature change in said integrated print head.

17. The computer product of claim 16, further comprising:

computer code configured to maintain a droplet count, said droplet count being a measure of a total number droplets ejected by said integrated print head;

computer code configured to trigger said calibration procedure or said end-of-life test based on said droplet count.

18. The computer product of claim 17, wherein said computer code is further configured to compare said droplet count and said temperature change to preset thresholds to estimate said ink level within said integrated print head.

19. The computer product of claim 18, wherein said preset thresholds further comprise first droplet threshold and upper temperature threshold.

20. The computer product of claim 19, wherein said computer code is configured to display a low-on-ink message if said droplet count exceeds said first droplet threshold; said computer code being further configured to display a out of-ink message if said temperature change exceeds said upper temperature threshold.

* * * * *

UNITED STATES PATENT AND TRADEMARK OFFICE

CERTIFICATE OF CORRECTION

PATENT NO. : 8,579,395 B2
APPLICATION NO. : 12/863719
DATED : November 12, 2013
INVENTOR(S) : Volker Smektala It is certified that error appears in the above-identified patent and that said Letters Patent is hereby corrected as shown below:

In the Claims

In column 8, line 38, in Claim 6, delete “an a” and insert -- a --, therefor.

In column 9, line 23, in Claim 13, delete “an a” and insert -- a --, therefor.

In column 10, line 25, in Claim 17, delete “number” and insert -- number of --, therefor.

In column 10, line 40, in Claim 20, delete “out” and insert -- out- --, therefor.

Signed and Sealed this
Eighteenth Day of March, 2014

Michelle K. Lee

Michelle K. Lee
*Deputy Director of the United States Patent and Trademark Office*